US006604307B1

(12) United States Patent
Cahill et al.

(10) Patent No.: US 6,604,307 B1
(45) Date of Patent: Aug. 12, 2003

(54) REMOVABLE FILM LABEL FOR COMPOSITE CONTAINERS

(75) Inventors: Glenda Cahill, Leicester, NC (US); Jeffrey M. Schuetz, Florence, SC (US); Barry R. Reese, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/547,587

(22) Filed: Apr. 12, 2000

(51) Int. Cl.[7] ..... G09F 3/00
(52) U.S. Cl. ..... 40/306
(58) Field of Search ..... 40/306; 428/34.2, 428/35.7; 229/45, 202

(56) References Cited

U.S. PATENT DOCUMENTS

| | | | | |
|---|---|---|---|---|
| 3,042,285 A | | 7/1962 | Smith | |
| 3,096,014 A | | 7/1963 | Swan | |
| 3,122,305 A | | 2/1964 | Young | |
| 3,202,566 A | | 8/1965 | Schur | |
| 3,354,506 A | | 11/1967 | Raley | |
| 3,371,841 A | | 3/1968 | O'Neal, Jr. | |
| 3,423,231 A | | 1/1969 | Lutzmann | |
| 3,423,341 A | | 1/1969 | Klare et al. | |
| 3,656,513 A | | 4/1972 | Evans et al. | |
| 3,940,496 A | | 2/1976 | Turpin et al. | |
| 3,981,433 A | | 9/1976 | Thornhill et al. | |
| 4,025,253 A | | 5/1977 | Havens | |
| 4,073,950 A | * | 2/1978 | Hansen et al. | 426/128 |
| 4,181,239 A | * | 1/1980 | Heiremans et al. | 220/461 |
| 4,235,341 A | | 11/1980 | Martin et al. | |
| 4,640,853 A | * | 2/1987 | Schmeal et al. | 428/35 |
| 5,076,440 A | | 12/1991 | Drummond | |
| 5,084,284 A | | 1/1992 | McDilda et al. | |
| 5,251,809 A | | 10/1993 | Drummond et al. | |
| 5,326,023 A | | 7/1994 | Rice et al. | |
| 6,036,629 A | * | 3/2000 | Rea et al. | 493/299 |

* cited by examiner

*Primary Examiner*—Cassandra H. Davis
(74) *Attorney, Agent, or Firm*—Alston & Bird LLP

(57) ABSTRACT

A multi-ply composite container for consumer products is provided having a tubular body ply and a film label ply. The tubular body ply is formed of paperboard material, and the film label ply is peelably adhered to the outer surface of the tubular body ply. The film label ply is comprised of a polymeric film having inner and outer layers formed from polymeric materials. The inner layer is permanently bonded to the outer layer such that the layers provide a film label ply having predictable tear characteristics, yet having the necessary strength to prevent premature rupture of the container. An adhesive is applied on at least a portion of the inner layer of the film label ply. The adhesive is for peelably adhering the label ply to the outer surface of the tubular body ply. A plurality of perforations or a laser score may also be included for directed a tear in the film label ply. Graphical matter can be included on at least a portion of the inner or outer layer of the film label ply.

40 Claims, 3 Drawing Sheets

REMOVABLE FILM LABEL FOR COMPOSITE CONTAINERS

FIELD OF THE INVENTION

The present invention relates to composite containers for food products, and more particularly, to one piece removable film labels applied to the outer surface of composite containers.

BACKGROUND OF THE INVENTION

In the packaging of perishable food products, a container is required that is rigid enough to retain its shape when subjected to internal pressure produced in the container while tightly sealing the food product to protect against deterioration, leakage, and contamination. Thus, perishable food products are often packaged in composite tubular containers that are sealed at both ends. In particular, refrigerated dough products typically are packaged in spiral wound containers which allow access to the dough products via the unwinding of the spiral seam. These containers rely mainly on the label to provide enough strength to retain the pressurized contents of the package until consumers use the product. The consumer peels the label from the package, allowing the container to open along the spiral seam, revealing the dough product. The tubular portion of these containers conventionally includes three separate plies or sets of plies.

First, at least one structural body ply made of paperboard material is included, which is formed into a tubular structure by wrapping a continuous strip of body ply paperboard material around a shaping mandrel. The body ply strip may be spirally wound around the mandrel or passed through a series of forming elements so as to be wrapped in a convolute shape around the mandrel. The tube is then cut into predetermined lengths at the downstream end of the mandrel and fitted with end closures to complete the container.

Second, these containers typically include a liquid impermeable liner ply adhered to the inner surface of the paperboard body ply. The liner ply seals the food product, such as dough, within the container and also prevents liquids, which may possibly contaminate the food product, from entering the container. Some liner plies are also gas impermeable, so as to not only prevent food product odors from escaping the can, but also prevent atmospheric air from entering the container and spoiling the food product. Thus, while the purpose of the body ply is to provide necessary structural properties to the container, the liner ply provides barrier properties necessary to protect and maintain the perishable food product.

Finally, a label ply, which is typically a paper-based ply, is included and adhered to the outer surface of the paperboard body ply. The label ply serves two primary functions. First, a composite can label is a source of information. The label carries the graphical matter that conveys product information, instructions, and regulatory compliance information. The label is also preferably decorative and aesthetically pleasing to the consumer, which enhances shelf appeal and increases consumer interest in the food product. The graphics included on conventional paper labels are either rotogravure or flexographically printed and, to protect the inks used in the label printing process, may require overlacquers over the inks. However, the overlacquers may not absorb evenly into the paper and thus create labels having poor aesthetic appearance.

The second function of the label ply is to provide some physical characteristics to the composite can. The coefficient of friction of the label ply is important because the lower the coefficient of friction, the easier the composite container is handled. The container is often routed along conveyor lines and chutes as it manufactured, filled and then shipped. Thus, a composite container with a high coefficient of friction can create inefficiencies in product packaging and increase the cost of packaging the food product, while a container with a low coefficient of friction can minimize such inefficiencies and costs.

Also, the wet strength of the label ply can be an important factor in composite container design. If the container is exposed to moisture and the paperboard body ply gets wet, the strength of the can is compromised. Such moisture is sometimes encountered during storage and shipping. At other times, condensation may form on the surface of the can if the can is refrigerated or otherwise exposed to cold temperatures and then moved to a warmer, humid environment. If the wet strength of the label ply is low, then the label will provide little additional relief to the body ply from premature rupturing of the container. Accordingly, a foil layer is often used as part of the label to add strength.

The wet strength of label plies is especially important when the plies are used in conjunction with composite cans for dough. Composite dough cans are designed differently from other composite containers such that they can be opened by forcefully striking the container against a sharp surface, such as the edge of a kitchen counter, or by pressing the seam of the container with a utensil. The edges of the body ply strip are typically abutted and held together with an unadhered or lightly adhered joint or seam. The label ply is thus designed to provide a substantial component of the total strength of the can necessary to prevent the can from prematurely opening. Accordingly, when the label ply or other outer wrapper is completely removed, the internal pressure of the dough and the force of impact against a sharp edge or pressure from a utensil causes the body ply seam to separate, thus allowing the dough product to be removed from the can. In some "self-opening" cans, it may not be necessary to provide external pressure after removing the label. In addition, dough containers are typically stored in refrigerated conditions. This type of storage is usually at high humidity. During storage the label material is exposed to moisture which can weaken the paperboard ply. This makes the strength of the label ply even more critical because if the label ply is exposed to moisture and has a low wet strength, as is the case with most paper labels, the container may prematurely rupture. In addition, the label is torn away to open the container, as discussed above. The line along which the label is torn, however, can occasionally deteriorate into a separation of the paper ply or plies which can leave some label material on the outer surface of the body ply. This problem, known as "feathering," can cause difficulties in opening the container.

As an alternative to conventional paper labels, several prior patents have mentioned the possible use of labels for dough cans or easy-open containers which are made of polymeric film. For example, U.S. Pat. No. 3,981,433 to Thornhill et al. discloses a composite container for dough with a peelable outer reinforcing or wrapper layer. According to the '433 patent, the peelable outer wrapper layer can be formed of paper, metal foil, or a suitable synthetic plastic material, such as polyethylene adhesively bonded to the outer surface of a fibrous body wall layer by way of a separately applied polyvinyl alcohol adhesive. U.S. Pat. No. 4,235,341 to Martin et al. discloses a dough container having inner and outer plies over a fiber board body ply. According to one embodiment the inner ply is a low density polyethylene film. The outer ply is described as a thermoplastic paper film. U.S. Pat. No. 5,076,440 to Drummond discloses a dough container having a label which can be of plastic film. U.S. Pat. No. 5,084,284 to McDilda et al. discloses a dough container with a label that can be made of a plastic film. U.S. Pat. No. 5,326,023 to Rice et al. discusses a dough container wherein the label layer is formed of a "suitable biaxially oriented polymer film." The film discussed therein comprises a polypropylene film.

These films could theoretically provide improved wet strength for dough can labels. However, the types of films potentially usable for dough can labels are limited. The label must be fairly easily removable so that the consumer can open the container to obtain the dough product inside. Accordingly, the type of film used must be easily separable from the body ply and easily graspable by the consumer to allow removal. Also, to properly open dough cans, the label is preferably completely removed or at least completely torn along a predetermined line so that the spiral seam of the body ply can be completely separated. Accordingly, the film label must be of such a type that it can be easily and completely removed from the container without feathering.

Some films have predictable tear characteristics; i.e., they tear in a predictable direction, and thus could be useful for dough can labels because of the potential to completely remove the label and expose the body ply seam. However, films having predictable tear characteristics may not provide the strength necessary to prevent the can from rupturing. More specifically, films having predictable tear characteristics typically are susceptible to stretching over time, known as "creep", as a result of pressure within the can attempting tocause expansion of the body ply seam, which undermines the strength of the label and the overall strength of the container. In addition, not all polymeric films have been proven to be capable of providing a peelable bond to a paperboard container, as is preferred in dough containers.

Accordingly, it would be desirable to provide a decorative composite container for expansible food products with a removable film label having improved label ply wet strength compared to paper labels and a decreased coefficient of friction, and could be peelably removed from the container without feathering. The label would preferably have sufficient strength and dimensional stability to be usable as a structural member of a dough container, but yet also be sufficiently tearable to allow easy opening of the container.

SUMMARY OF THE INVENTION

These and other needs are provided, according to the invention, by a decorative composite container for consumer products having a tubular body ply and a film label ply which is adhered to the body ply. The film label ply comprises a polymeric film or laminate having inner and outer layers permanently bonded together, wherein one of the layers is formed of a polymeric material having predictable tear characteristics and the other of the layers has a high resistance to creep in the circumferential direction. As an example, a film label ply having an inner layer formed of oriented high density polyethylene and an outer layer formed of polyethylene terephthalate advantageously has both predictable tear characteristics due to the oriented polyethylene and a high resistance to creep because of the polyethylene terephthalate. Thus, a highly desirable removable label for composite containers is provided which solves all of the problems of conventional labels outlined above.

In particular, a tubular composite container for advertising products contained therein to consumers is provided wherein the tubular body ply is formed of paperboard material having inner and outer surfaces and opposed ends. The film label ply is wrapped around the outer surface of the tubular body ply and is tearable away from the tubular body ply so that the body ply can be separated and the container opened. As noted above, the film label ply comprises a polymeric film or laminate having inner and outer layers. The inner layer is peelably adhered to the tubular body ply and is formed of a polymeric material of a first type, preferably comprising a polyethylene film having predictable tear characteristics. The outer layer of the film label ply is permanently bonded to the inner layer and is formed of a polymeric material of a second type, preferably comprising polyethylene terephthalate having sufficient strength to prevent label ply creep.

Graphical indicia are applied on at least a portion of the film label ply so as to be visible to the consumer. These indicia can be applied on the outer surface of the outer layer of the film label ply or on the inner surface of a transparent outer layer to be visible to a consumer before the container is opened. In addition, indicia such as coupons or games can also be applied to the inner surface of the inner layer of the label so as to be visible to the purchasing consumer after the label is removed. An adhesive such as dextrin is in contact with at least a portion of the inner layer of the film label ply for adhering the label ply to the outer surface of the tubular body ply. The label peel strength should be sufficient to prevent movement of the label so that the container will not open prematurely. The adhesive applied between the inner layer of the label ply and the outer surface of the tubular body ply can be a heat seal coating, a cold seal coating, or even a pressure sensitive adhesive.

The film label ply may be wrapped around the body ply so as to create overlapped edges defining a seam extending between the opposed ends of the tubular body ply. A hot melt adhesive can be applied between the overlapped edges for bonding the overlapped edges, or the adhesive used to adhere the film label ply to the body ply can be used to also adhere the overlapped edges together. The film label ply preferably has predictable tear characteristics, so that a tear in the film label ply initiated by the consumer will follow a path directed by the film label ply. Alternatively, a plurality of perforations or a laser score extending around the outer surface of the tubular body ply may be used for directing a tear in the film label ply.

The decorative tubular composite container according to the invention is preferably for use with dough cans and thus is designed to be opened through a sidewall thereof. Accordingly, the tubular body ply defines a seam at which opposite edges of the paperboard material are abutted and held together with an unadhered or lightly adhered joint or seam. The film label is adhered to the outer surface of the tubular body ply such that as the film label is peeled away from the tubular body ply, the body ply separates to reveal the contents of the container.

The invention provides a decorative multi-ply composite container having graphical indicia applied to the inner layer and/or the outer layer of the film label. The graphical indicia are thus protected from external forces by the outer layer of the film label and/or a layer of overlacquer, depending on which surfaces the graphical indicia are applied. In addition, the wet strength of the film label ply is no less than the strength of the film when not wet. Thus, the multi-ply composite container and polymeric film label of the present invention provide a container having the strength necessary to survive refrigerated storage and withstand the rigors of transportation, yet being easily and completely removable by the consumer.

BRIEF DESCRIPTION OF THE DRAWINGS

Some of the objects and advantages of the present invention have been set forth and other objects and advantages of the invention will become apparent in the detailed description of the preferred embodiments of the invention to follow, especially when taken in conjunction with the accompanying drawings, which are not necessarily drawn to scale.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
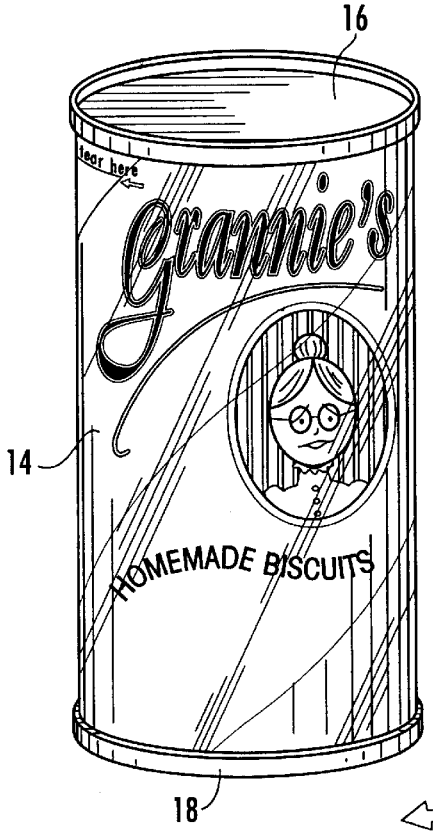
FIG. 1 is a perspective view of a multi-ply composite container according to the present invention.

FIG. 1 illustrates a tubular multi-ply composite container 10 for consumer products according to the present invention. Although illustrated as having a circular cross section, the tube may have any cross sectional shape which can be formed by wrapping the tube around an appropriately shaped mandrel. One example is a generally rectangular shaped tube having rounded corners.

Figure 2:
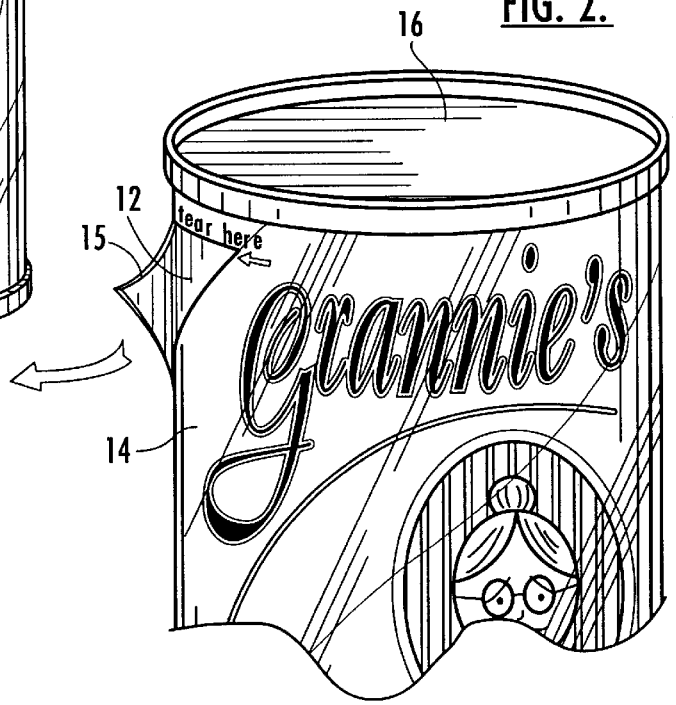
FIG. 2 is an enlarged fragmentary view of an embodiment of the film label ply according to the present invention.

The embodiment illustrated in FIGS. 1 and 2 is particularly advantageous for packaging dough products such as biscuits or rolls and includes a tubular body ply 12, a liner ply (not shown) adhered to the inner surface of the tubular body ply 12, and a film label ply 14 adhered to the outer surface of the tubular body ply 12. The liner ply may be omitted in certain applications such as packages for dry materials like salt. The composite container 10 also includes a plastic or metal end closure 16. A plastic or metal closure 18 can be secured to the opposite end of the composite container 10. Various other end closures may be used depending upon the type of food product which is to be packaged.

Figure 3:
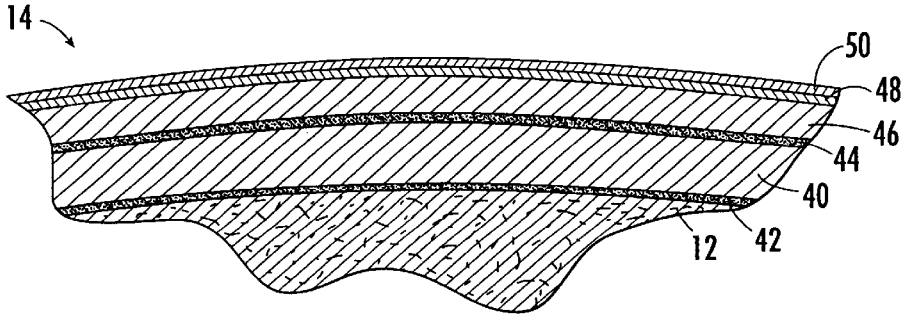
FIG. 3 is a cross-sectional and enlarged view of one embodiment of the film label ply according to the present invention.
Figure 4:
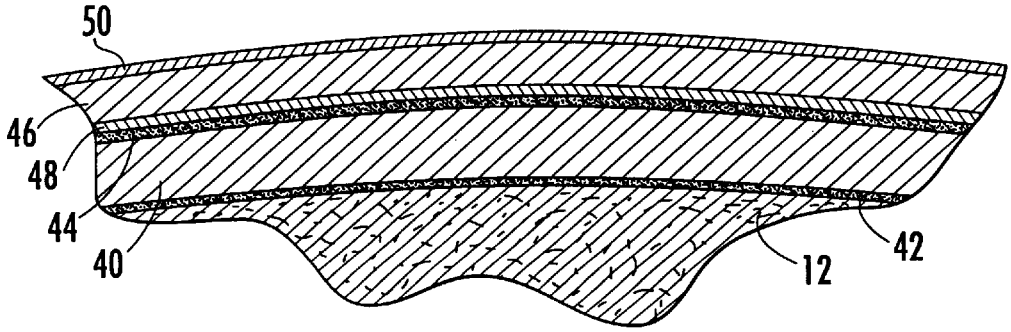
FIG. 4 is a cross-sectional and enlarged view of another embodiment of the film label ply according to the present invention.

The tubular body ply 12 of the composite container 10 is preferably formed of paperboard material, and the film label ply 14, which is adhered to the outer surface of the tubular body ply 12, is preferably formed of a polymeric material. The film label ply 14 comprises two layers permanently bonded to one another. Referring to FIGS. 3 and 4, the inner layer 40 comprises a polymeric material, preferably oriented high density polyethylene (HDPE) having predictable tear characteristics. Other possible materials for the inner layer 40 include oriented polypropylene, oriented polyamide, and laminations thereof. The inner layer 40 preferably provides predictable tear characteristics by allowing the material to tear predominately in the specific direction dictated by the polymer orientation.

The inner layer 40 is removably adhered to the body ply 12 using an adhesive 42, such as a dextrin adhesive. Other adhesives are also possible, such as a heat seal coating that is temperature activated, a cold seal coating, or a pressure sensitive adhesive. The adhesive 42 can be applied to the entire inner surface of the inner layer 40 or can be disposed only on a portion thereof and in either case preferably forms a peelable seal. The adhesive 42 could be separately applied to the body ply 12 and/or the inner layer 40 of the film label ply 14 during the manufacture of the container such as with rollers and the like. For example, a cold seal coating could be applied to both the tubular body ply 12 and the inner layer 40 of the film label ply 14 to promote better adhesion. In addition, a portion of the film label 14 defines a grasping point 15 for the consumer to begin initiating a tear in the film label 14. The peelable seal preferably has a peel strength of approximately 0.06–0.25 lbs./in, and in particular about 0.20 lbs./in. The peel strength should perform at a level sufficient to prevent movement of the label 14 in order to prevent premature opening of the container 10, yet allow easy removal of the label 14 by the consumer.

The inner layer 40 may be a material such as high density polyethylene as noted above. However, high density polyethylene can stretch or creep over time in the circumferential direction when tension is applied, such as from outward expansion of the body ply caused by the expansion of the food product in the container. The creep could be deleterious to the container if excessive, and could lead to premature opening of the container.

Advantageously, the film label 14 of the present invention further comprises an outer layer 46. The outer layer 46 comprises a polymeric material preferably having enough strength to prevent the body-ply 12 from prematurely rupturing while providing a surface suitable for displaying graphics or instructions. The outer layer 46 preferably comprises 45 gauge polyethylene terephthalate (PET), although other thicknesses and films such as polyolefin materials may be used. Polyethylene terephthalate films would typically not be used singularly as a film label 14 or dough containers because of low graspability and unpredictable tear characteristics. Thus, the inner layer 40 and outer layer 46 are permanently bonded together to provide a film label ply 14 having high strength and predictable tear characteristics. In addition, the outer layer 46 preferably has a kinetic coefficient of friction at least as low as about 0.3 and may be coated with an overlacquer 50 which can reduce the coefficient of friction even lower to at least about 0.2. In one embodiment, the overlacquer 50 is a catalytic overlacquer, although other overlacquers may be used, such as a nitrocellulose overlacquer.

Figure 5:
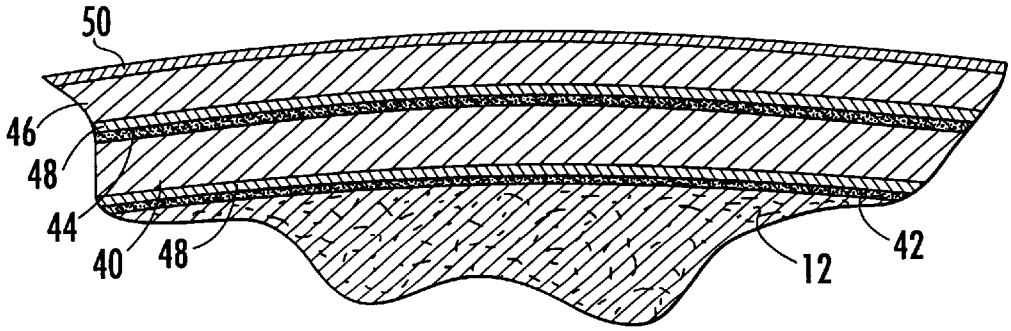
FIG. 5 is a cross-sectional and enlarged view of another embodiment of the film label ply according to the present invention.

The outer layer 46 and inner layer 40 are permanently bonded together using an adhesive 44, such as any conventional adhesive used for polyethylene terepthalate and high density polyethylene materials. The outer layer 46 includes graphical indicia 48 applied to at least one surface thereof. The graphical indicia 48 may include product information, coupons, games, package opening instructions, and/or regulatory compliance information and are, according to one embodiment, printed on the outer layer 46. Referring to FIGS. 3 and 4, the indicia 48 may be printed on the outer surface of the outer layer 46, or can be printed on the inner surface of the outer layer (if formed of a transparent material) using a process known as "reverse printing." Reverse printing the graphical indicia 48 on the inner surface of the outer layer 46 advantageously protects the graphical indicia from exposure to outside elements, and therefore protects the indicia from blurring, staining, or scratching. The graphical indicia 48 can be rotogravure or flexographically printed on the outer layer 46. A layer of overlacquer 50 can be applied to the outer surface of the outer layer 46 to protect the film label 14 from outside elements. FIG. 5 shows another embodiment of the present invention wherein the indicia 48 are applied to the inner surface of the inner layer 40. In this embodiment, the indicia 48 may be applied using reverse printing in conjunction with a transparent outer layer 46, or the indicia may be rotogravure or flexographically printed in conjunction with a non-transparent outer layer.

Figure 6:
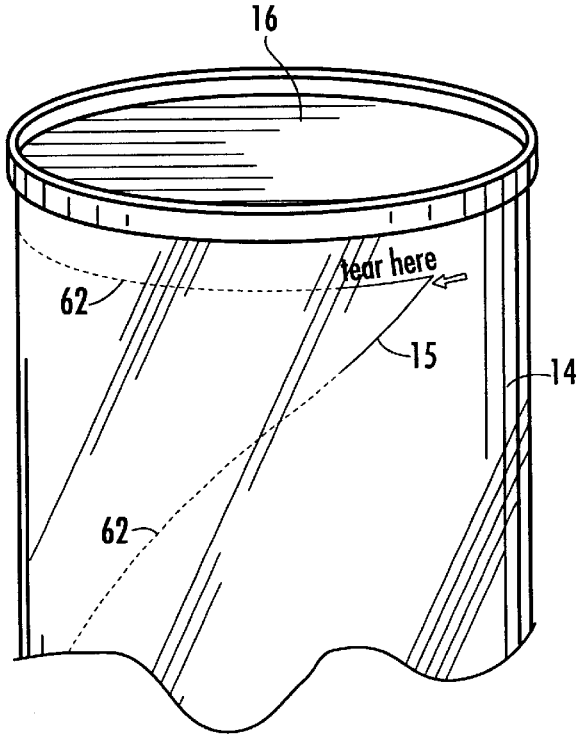
FIG. 6 is a perspective view of the present invention showing a tear path directed by perforations.
Figure 7:
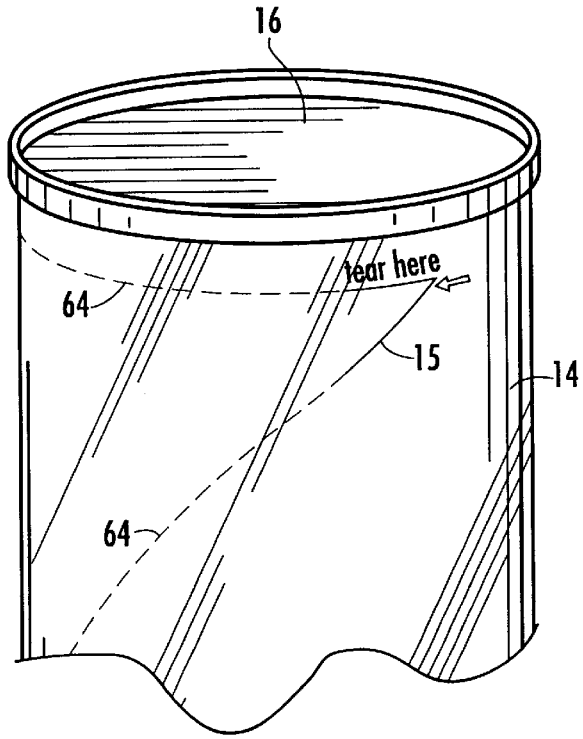
FIG. 7 is a perspective view of the present invention showing a tear path directed by laser score.

The film label ply 14 is designed such that when the film label ply 14 is adhered to the outer surface of the tubular body ply 12, the film label ply 14 includes overlapped edges defining a seam extending between the opposed ends of the tubular body ply 12. An adhesive is included between the overlapped edges for bonding. The adhesive may be the adhesive 42 mentioned above and/or a separate hot melt adhesive application. As described above, the inner layer 40 preferably has predictable tear characteristics, so that the film label ply 14 may be peeled away from the tubular body ply 12 along a tear path directed by the inner layer. The tear path facilitates removal of the film label ply 14 from the tubular body ply 12 so that the composite container 10 can be easily opened. In one embodiment the inner layer 40 comprises an oriented polymer. The polymer can be oriented around the tubular body ply 12 such that the orientation of the polymer provides a predictable tear path for the film label ply 14 along the direction of orientation. For example, the film label ply 14 may be oriented such that the tear path is in a circumferential direction about the composite container 10. Alternatively, the film label ply 14 may be wrapped around the tubular body ply 12 in a helical direction such that the tear path directed by the orientation of the polymer is along the helical direction. In one advantageous embodiment, the film label ply 14 is wrapped around the tubular body ply 12 such that the tear path is in the circumferential direction, while the seam defined by the tubular body ply and the overlapped edges of the film label ply are in a substantially similar helical direction. In this regard, the film label ply 14 can be peeled away from the tubular body ply 12 along the tear path and along the seam defined by the overlapped edges of the film label ply extending between the opposed ends of the tubular body ply. Alternatively, FIGS. 6 and 7 show a line of perforations 62 and a laser score 64 in the film label 14 which may also be used to direct a tear along a desired tear path.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed herein and that modifications and other embodiments are intended to be included within the scope of the appended claims. For example, the tubular containers according to the present invention are not necessarily helically wound but may instead be longitudinally wrapped to create a "convolute" tube having an axially extending seam. In addition, although the tubular containers according to the present invention have been described primarily in connection with food products, it is to be understood that the containers could be used in connection with other products. Although specific terms are employed herein, they are used in a generic and descriptive sense only and not for purposes of limitation.

That which is claimed is:

1. A tubular composite container which is openable through a sidewall thereof, said container comprising:

a tubular body ply formed of paperboard material having inner and outer surfaces and opposed ends, said body ply further defining a seam where opposed edges of said body ply are positioned adjacent each other; and a film label ply around said outer surface of said tubular body ply, said film label ply being tearable away from said body ply such that said body ply seam can be separated and said container opened, said film label ply comprising, an inner layer having inner and outer surfaces, said inner layer being peelably adhered to said outer surface of said tubular body ply and being formed of a polymeric material of a first type, and an outer layer having inner and outer surfaces, said outer layer being permanently bonded to said inner layer and being formed of a polymeric material of a second type, one of said layers having a higher resistance to creep in the circumferential direction than the other of said layers.

2. A tubular composite container according to claim 1, wherein said outer layer has a higher resistance to creep than said inner layer.

3. A tubular composite container according to claim 1, wherein said first type of material of said inner layer comprises polyethylene film.

4. A tubular composite container according to claim 3, wherein said polyethylene film is an oriented high density polyethylene film.

5. A tubular composite container according to claim 1, wherein said second type of material of said outer layer comprises polyethylene terephthalate film.

6. A tubular composite container according to claim 1, further comprising graphical indicia applied on at least a portion of said film label ply.

7. A tubular composite container according to claim 6, wherein said graphical indicia are applied on the outer surface of said outer layer of said film label ply.

8. A tubular composite container according to claim 6, wherein said graphical indicia are applied on the inner surface of said outer layer of said film label ply.

9. A tubular composite container according to claim 6, wherein said graphical indicia are applied on the inner surface of said inner layer of said film label ply.

10. A tubular composite container according to claim 1, wherein said film label ply is wrapped around said tubular body ply in a helical direction and said inner layer of said film label ply is formed of an oriented polymeric material that is oriented to tear along said helical direction.

11. A tubular composite container according to claim 1, wherein said film label ply is wrapped around said tubular body and said inner layer of said film label ply is formed of an oriented polymeric material that is oriented to tear along said circumferential direction.

12. A tubular composite container according to claim 1, wherein said film label ply is adhered to said tubular body ply using a dextrin adhesive.

13. A tubular composite container according to claim 1, further comprising an overlacquer applied to said outer layer.

14. A tubular composite container according to claim 13, wherein said overlacquer comprises a catalytic overlacquer.

15. A tubular composite container according to claim 1, wherein said inner layer and said outer layer of said film label ply are laminated together.

16. A tubular composite container according to claim 1, wherein said film label ply has a peel strength between 0.06–0.25 lbs./in.

17. A tubular composite container according to claim 1, wherein said inner layer comprises an oriented polypropylene material.

18. A tubular composite container according to claim 1, further comprising a plurality of perforations extending around said film label ply adjacent said opposed ends for directing a tear along said perforations.

19. A tubular composite container according to claim 1, further comprising a laser score extending around said film label ply adjacent said opposed ends for directing a tear along said laser score.

20. A film label for a tubular composite container which is openable through a sidewall thereof, said film label comprising:

an inner layer having inner and outer surfaces, said inner layer being peelably adherable to an outer surface of the tubular composite container and being formed of a polymeric material of a first type; and an outer layer having inner and outer surfaces, said outer layer being permanently bonded to said inner layer and being formed of a polymeric material of a second type, one of said layers having a higher resistance to creep in the circumferential direction than the other of said layers.

21. A film label according to claim 20, wherein said outer layer has a higher resistance to creep than said inner layer.

22. A film label according to claim 20, wherein said first type of material of said inner layer comprises polyethylene film.

23. A film label according to claim 22, wherein said polyethylene film is an oriented high density polyethylene film.

24. A film label according to claim 20, wherein said second type of material of said outer layer comprises polyethylene terephthalate film.

25. A film label according to claim 20, further comprising graphical indicia applied on at least a portion of said film label.

26. A film label according to claim 25, wherein said graphical indicia are applied on the outer surface of said outer layer.

27. A film label according to claim 25, wherein said graphical indicia are applied on the inner surface of said outer layer.

28. A film label according to claim 25, wherein said graphical indicia are applied on the inner surface of said inner layer.

29. A film label according to claim 20, wherein said film label is adapted to be wrapped around the tubular composite container in a helical direction and said inner layer of said film label is formed of an oriented polymeric material that is oriented to tear along said helical direction.

30. A film label according to claim 20, wherein said film label is adapted to be wrapped around said tubular body and said inner layer of said film label ply is formed of an oriented polymeric material that is oriented to tear along said circumferential direction.

31. A film label according to claim 20, wherein said film label has a peel strength between 0.06–0.25 lbs./in.

32. A film label according to claim 20, wherein said film label is adhered to said tubular composite container using a dextrin adhesive.

33. A film label according to claim 20, further comprising an overlacquer applied to said outer layer.

34. A film label according to claim 33, wherein said overlacquer comprises a catalytic overlacquer.

35. A film label according to claim 20, wherein said inner layer and said outer layer are laminated together.

36. A film label according to claim 20, wherein said inner layer comprises an oriented polypropylene material.

37. A film label according to claim 20, further comprising a plurality of perforations extending around said film label for directing a tear along said perforations.

38. A film label according to claim 20, further comprising a laser score extending around said film label for directing a tear around said laser score.

39. A tubular composite container which is openable through a sidewall thereof, said container comprising:

a tubular body ply formed of paperboard material having inner and outer surfaces and opposed ends, said body ply further defining a seam where opposed edges of said body ply are positioned adjacent each other; and a film label ply around said outer surface of said tubular body ply, said film label ply being tearable away from said body ply such that said body ply seam can be separated and said container opened, said film label ply comprising, an inner layer having inner and outer surfaces, said inner layer being peelably adhered to said outer surface of said tubular body ply and being formed of a polymeric material of a first type, and an outer layer having inner and outer surfaces, said outer layer being adhesively laminated to said inner layer and being formed of a polymeric material of a second type, one of said inner and outer layers having a higher resistance to creep than the other of said layers.

40. A film label for a tubular composite container which is openable through a sidewall thereof, said film label comprising:

an inner layer having inner and outer surfaces, said inner layer being peelably adherable to an outer surface of the tubular composite container and being formed of a polymeric material of a first type; and an outer layer having inner and outer surfaces, said outer layer being adhesively laminated to said inner layer and being formed of a polymeric material of a second type, one of said inner and outer layers having a higher resistance to creep than the other of said layers.

* * * * *